US006629693B2

(12) United States Patent
Siow et al.

(10) Patent No.: US 6,629,693 B2
(45) Date of Patent: Oct. 7, 2003

(54) SHEET MEDIA HANDLING SYSTEM AND PRINTER HAVING THE SAME

(75) Inventors: We-Lym Darren Siow, Singapore (SG); Ching Yong Chua, Singapore (SG); Pui Wen Huang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 44 days.

(21) Appl. No.: 10/039,492

(22) Filed: Oct. 26, 2001

(65) Prior Publication Data

US 2003/0080496 A1 May 1, 2003

(51) Int. Cl.[7] ..... B65H 1/00
(52) U.S. Cl. ..... 271/171; 271/148
(58) Field of Search ..... 271/148, 162, 271/171, 164, 218, 219; 399/393

(56) References Cited

U.S. PATENT DOCUMENTS 5,573,234 A * 11/1996 Petocchi ..... 271/9.01
5,595,380 A * 1/1997 McCue et al. ..... 271/9.09
6,152,440 A 11/2000 Yip et al.
6,169,561 B1 * 1/2001 Fisher, Sr. ..... 347/218

FOREIGN PATENT DOCUMENTS

JP 6-87539 * 3/1994 ..... B65H/1/00

* cited by examiner

*Primary Examiner*—Donald P. Walsh
*Assistant Examiner*—Kenneth W Bower
(74) *Attorney, Agent, or Firm*—Richard Main

(57) ABSTRACT

A sheet media handling system suitable for use with a printer is disclosed. The sheet media handling system includes a first support and a second support adjacent the first support. In use, the first support supports first sheet media and second sheet media on the first sheet media. The second support supports a portion of second sheet media that is not supported by the underlying first sheet media. A biasing means biases the second support. The biasing means is collapsible under the portion of up to a predetermined number of sheets of the second sheet media. During a pick cycle when the first support is moved to present supported media thereon to an infeed zone of the printer, the portion topmost of the second sheet media is brought to within a predetermined tolerance of the infeed zone.

19 Claims, 4 Drawing Sheets

SHEET MEDIA HANDLING SYSTEM AND PRINTER HAVING THE SAME

BACKGROUND

This invention relates to a sheet media handling system and a printer having the same for supporting both small and large width sheet media. More particularly, this invention relates to a sheet media handling system and printer having the same for presenting a large width sheet medium, that is partially supported by a stack of small width sheet media, substantially aligned to an infeed zone of the printer.

Office equipment such as photocopiers, laser printers, ink jet printers and other imprinting mechanisms today incorporate an ability to receive sheet media from any one of two or more trays. It is very common to have a bypass tray in which a single sheet medium of a special type or of a different size can be conveniently fed for particular printing without having to load it onto pull-out trays.

FIG. 1A shows one prior art media handling system having a pressure plate pivotably mounted on a base of a printer. During a pick cycle, the pressure plate is lifted to move a stack of sheet media located above it to an infeed zone of the printer. This pressure plate is usually designed to directly support a stack of sheet media in a main tray. During each pick cycle, the sheet at the top of the stack will be moved to the infeed zone. A simple and economical design of a bypass feeding system usually has a bypass tray positioned above the main tray. Sheet media in this bypass tray is supported either by the pressure plate itself (when there is no sheet medium in the main tray) or by a stack of sheet media in the main tray as shown in FIG. 1A. Such a design accords pick priority to any sheet medium in the bypass tray over that in the main tray. This design works well when the sheet media on both the bypass and main trays are of substantially the same width. When the media are of substantially the same widths, the sheet media in the main tray will be able to provide sufficient support for the sheet media in the bypass tray.

However, a serious problem results when the sheet medium in the bypass tray is substantially wider than a stack of sheet media in the main tray. For example, the sheet media in the bypass tray is of B4 size and the sheet media in the main tray is of A4 or Letter size. A substantially large portion of the B4 size sheet medium in the bypass tray will not be supported by the A4 or Letter size sheet media in the main tray. The problem is not so serious when there is only a small stack of sheet media in the main tray. A small stack will create only a small height differential between portions of the B4 size sheet medium. In such a case, the B4 size sheet medium is still fairly well supported, partly by the stack of sheet media in the main tray and partly by the exposed portion of the pressure plate. As a result, the B4 size sheet medium can be properly presented for picking by the pick mechanism in the printer.

However, when the stack height of the smaller width sheet media in the main tray measures half an inch or more, a relatively large portion of the B4 size sheet medium would not be supported by the pressure plate and would sag at the arris of the stack of sheet media in the main tray as shown in FIG 1A. Such sagging is detrimental to the aligned feeding of the B4 size sheet medium into the printer as the sheet medium will not be properly presented to the pick mechanism. The pick mechanism is only able to properly engage the portion of the B4 size sheet medium that is supported by the stack of sheet media in the main tray as shown in FIG. 1B. As a result, the properly engaged portion will be drawn into the printer ahead of the rest of the sheet medium. Such an action would cause the sheet medium to follow an oblique course or a deviation from a predetermined straight line path when being received into the printer. Such unbalanced drawing in of the B4 size sheet medium results in skewing of the sheet medium. This skewing causes undesirable result, for text printed on the skewed sheet medium will appear misaligned, crooked or oblique. In some cases, when the skew is severe, the sheet medium may end up jamming the printer.

A two-part pressure plate disclosed in the U.S. Pat. No. 6,152,440 can be used to overcome the problem of unbalanced support or sagging of the B4 size sheet medium. The pressure plate includes a primary pressure plate for supporting media in the main tray and a secondary pressure plate that is raised to support portions of a larger width sheet media that is not supported by media in the main tray. The secondary pressure plate is actuated by a mechanism that is responsive to a media guide used to align a stack of sheet media in the main tray. Although such a design works well, it is not possible to implement the mechanism where space is a constraint. The secondary pressure plate is also inoperative if a user forgets to move the media guide into position against the stack of sheet media in the main tray.

SUMMARY

According to an embodiment of the present invention, there is provided a sheet media handling system suitable for use with a printer. The sheet media handling system includes a first support and a second support adjacent the first support. In use, the first support supports first sheet media and second sheet media on the first sheet media. The second support supports a portion of second sheet media that is not supported by the underlying first sheet media. A biasing means biases the second support. The biasing means is collapsible under the portion of up to a predetermined number of sheets of the second sheet media. During a pick cycle when the first support is moved to present supported media thereon to an infeed zone of the printer, the portion topmost of the second sheet media is brought to within a predetermined tolerance of the infeed zone.

Further according to the embodiment of the present invention, there is provided a printer that includes the above sheet media handling system.

BRIEF DESCRIPTION OF DRAWINGS

The invention will be better understood with reference to the drawings, in which:

FIGS. 8A and 8B are drawings similar to FIGS. 7A and 7B, showing the first support and the second support supporting a small stack of large width sheet media;

DETAILED DESCRIPTION

Hereafter, a preferred embodiment of the present invention will be described in the context of an ink jet printer having a main media tray and a bypass tray. However, it is to be understood that the invention is usable with any imprinting or sheet handling equipment that receives a larger width sheet media that is partially supported by a smaller width sheet media thereunder.

Figure 2:
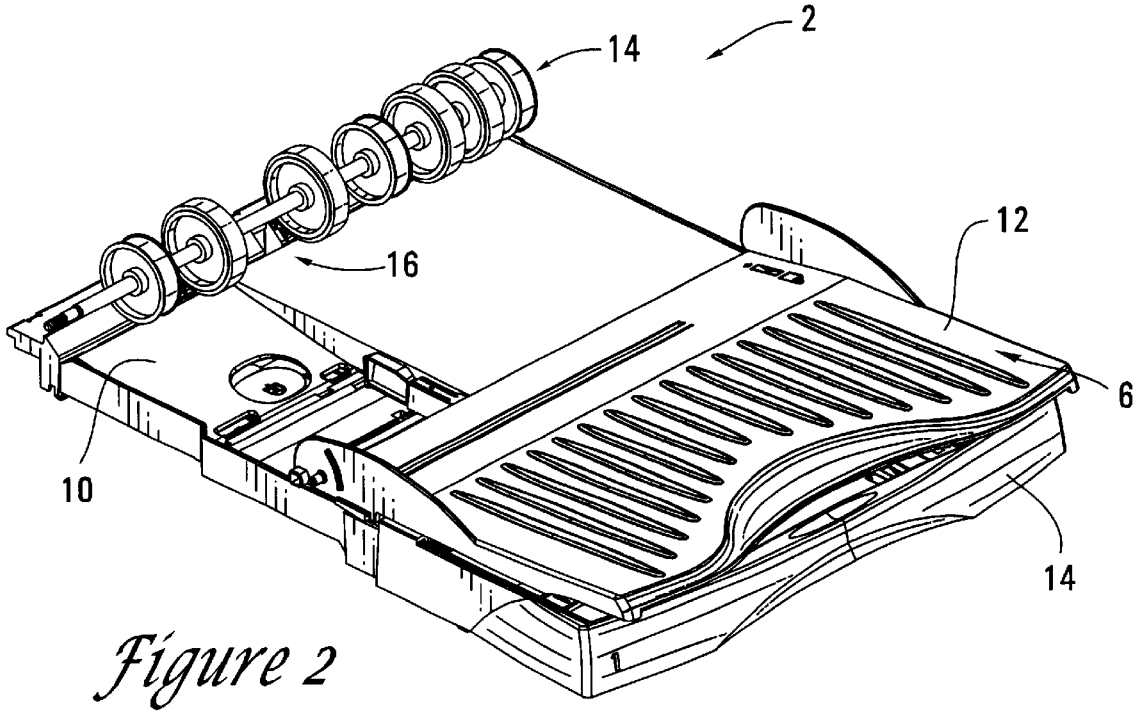
FIG. 2 is an isometric drawing of a portion of an ink jet printer having a sheet media handling system according to an embodiment of the present invention, the sheet media handling system has a first support and a second support that is biased by a biasing means.
Figure 3:
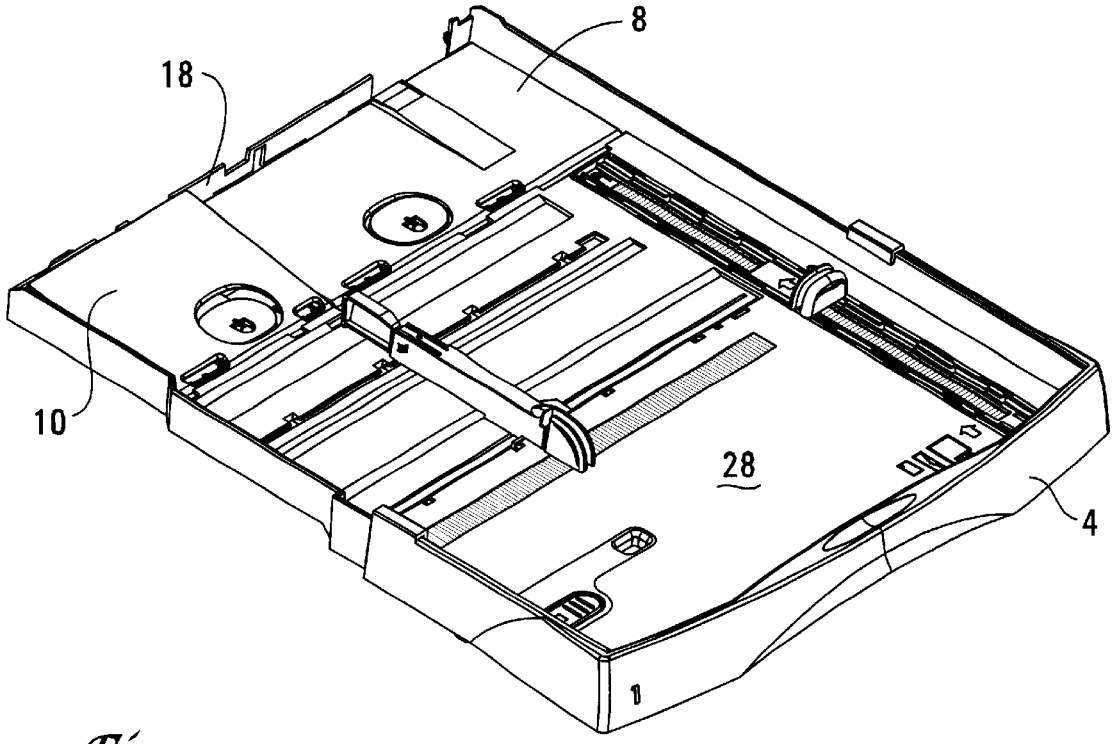
FIG. 3 is an isometric drawing of a pull-out tray that supports the first support and the second support in FIG. 2.

FIG. 2 is an isometric view of a portion of an ink jet printer 2 with a sheet media handling system partially implemented in a pull-out tray 4. FIG. 3 is an isometric view of the pull-out tray 4. The printer 2 includes a bypass tray, generally indicated by a reference numeral 6, that is located above the pull-out tray 4. The pull-out tray 4 includes pivotably supported adjacent first and second supports 8, 10 (FIG. 3) that can be tilted largely independently of each other. The first support 8 however includes an engagement portion 9 (FIG. 4) which when allowed to do so engages the second support 10 to tilt the second support 10 together with the first support 8.

Typically, the bypass tray 6 includes an exposed panel 12 on which sheet media may be placed, guided and supported by either the first and the second supports 8, 10 of the pull-out tray 4 or any sheet media supported thereon. The printer 2 has a pick mechanism 14 that defines an infeed zone, generally indicated by a reference numeral 16.

A cam (not shown) attached to the pick mechanism holds the first support 8 in an unused position away from the infeed zone 16 when the printer 2 is not in a pick cycle. During the pick cycle, the first support 8 is biased towards the infeed zone 16. When biased, the first support 8 moves towards the infeed zone 16 to present a sheet medium for picking by the pick mechanism 14. If sheet media are present in both the pull-out tray 4 and the bypass tray 6, the topmost sheet medium in the bypass tray 6 will be picked. If there are only sheet media in the pull-out tray 4, the topmost sheet medium in the pull-out tray 4 will be picked.

After a sheet medium is drawn into the infeed zone 16 of the printer 2, the sheet medium is advanced into a print zone (not shown) of the printer 2 for printing. During the advancing of the sheet medium, the cam is rotated to move the first support 10 away from the infeed zone 16 so that no new sheet medium can be drawn into the printer 2.

The width of the second support 10 is determined by the sizes of sheet media to be supported by the sheet media handling system. In this preferred embodiment, it is determined that the smaller width sheet media to be supported include A4, Letter and other smaller sizes. Accordingly, the width of the first support 8 is selected to be about 10 inches. The width of the second support 10 is appropriately selected so as to provide the necessary support for larger width sheet media, such as B+ media. Accordingly, the width of the second support is selected to be about 4 inches.

Figure 4:
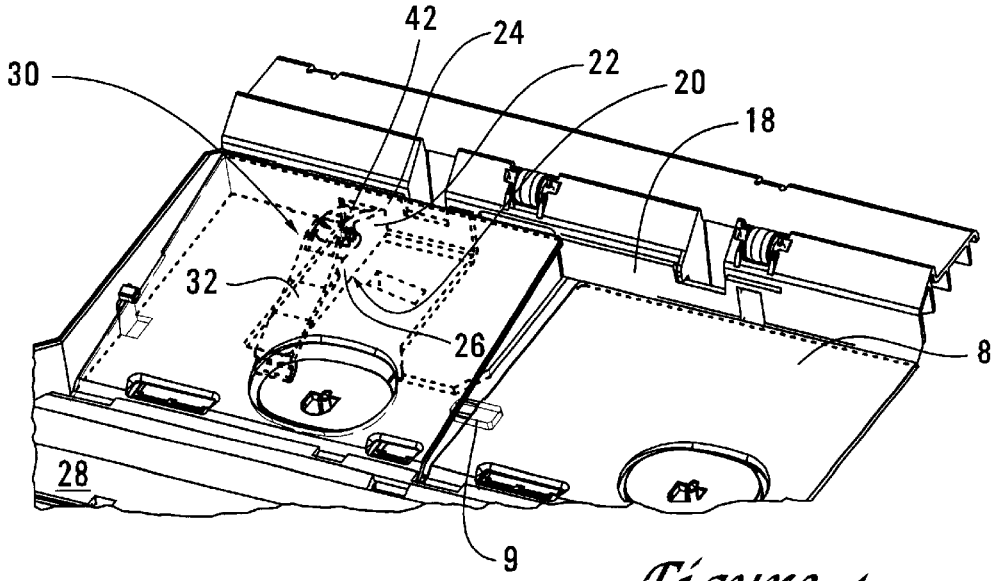
FIG. 4 is an isometric drawing of the pull-out tray in FIG. 3 shown attached to a printer to allow the biasing means that is supported on the ink jet printer to bias the second support.

The pull-out tray 4 includes a leading side wall 18 and an orthogonal aperture 20 (FIG. 4) having a first aperture portion 22 formed under an overhanging portion 24 in the leading side wall 18 and a second aperture portion 26 formed on a base 28 of the pull-out tray 4 located under the second support 10. When the pull-out tray 4 is attached to the printer 2 as shown in FIG. 4, a biasing means 30 extends into the pull-out tray 4 through the orthogonal aperture 20 to engage the second support 10 to thereby bias it.

Figure 5:
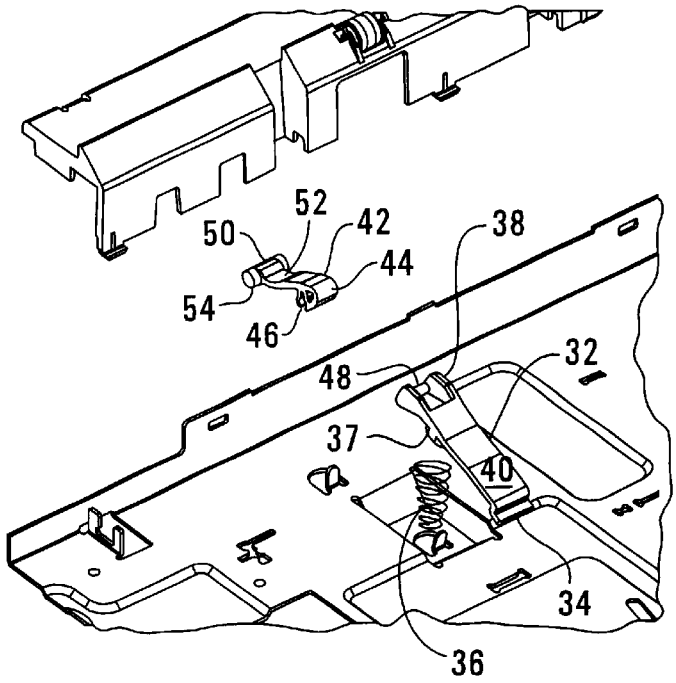
FIG. 5 is an exploded drawing of the biasing means in FIG. 2.

FIG. 5 is an exploded drawing of the biasing means 30. The biasing means 30 includes a first or leading lever 32 having a first stepped end 34 pivotably mounted to the printer base 28. The biasing means also includes a coil spring 36 that has one end anchored onto the base 28 of the printer 2 and the other end seated in a seat 37 formed on an undersurface of the first lever 32. The coil spring 36 is preferably a spiral that is collapsible to a low profile so as not to limit the height of a stack of sheet media placed in the pull-out tray 4.

When assembled, the coil spring 36 biases the first lever 32 to raise a second bifurcated end 38 of the first lever 32 to define a first incline 40. The biasing means 30 also includes a second or trailing lever 42 that has a first end 44 pivotably attached to the raised second end 38 of the first lever 32. The first end 44 is pivotably attached for example by snap fitting a catch 46 of the second lever 42 onto a hinge bar 48 of the first lever 32. When attached in this manner, a free second end 50 of the second lever 42 extends in an opposite direction to the first lever 32 to define a second incline 52.

When the pull-out tray 4 is slid along the printer base 28 for attachment to the printer 2, there will come a point where the overhanging portion 24 of the leading side wall 18 comes into contact with the first incline 40 defined by the biased first lever 32. As the pull-out tray 4 slides further along, the overhanging portion 24 pushes the first lever 32 down towards the printer base 28. The overhanging portion 24 will continue to push the first lever downwards until the overhanging portion 24 is moved beyond the second end 38 of the first lever 32 to rest on the second incline 52 of the second lever 42. During the sliding of the pull-out tray 4, the second support 10 rides up the first incline 40. As the overhanging portion 24 clears the first lever 32, the compressed coil spring 36 extends to bias the second support 10 to its datum position. The overhanging portion 24 will eventually come to rest on the second incline 52 as shown in FIG. 4. When the pull-out tray 4 is drawn out of the printer 2, the overhanging portion 24 rides up the second incline 52 to push the second lever 42 downwards to allow the overhanging portion 24 to clear the biasing means 30.

Figure 6:
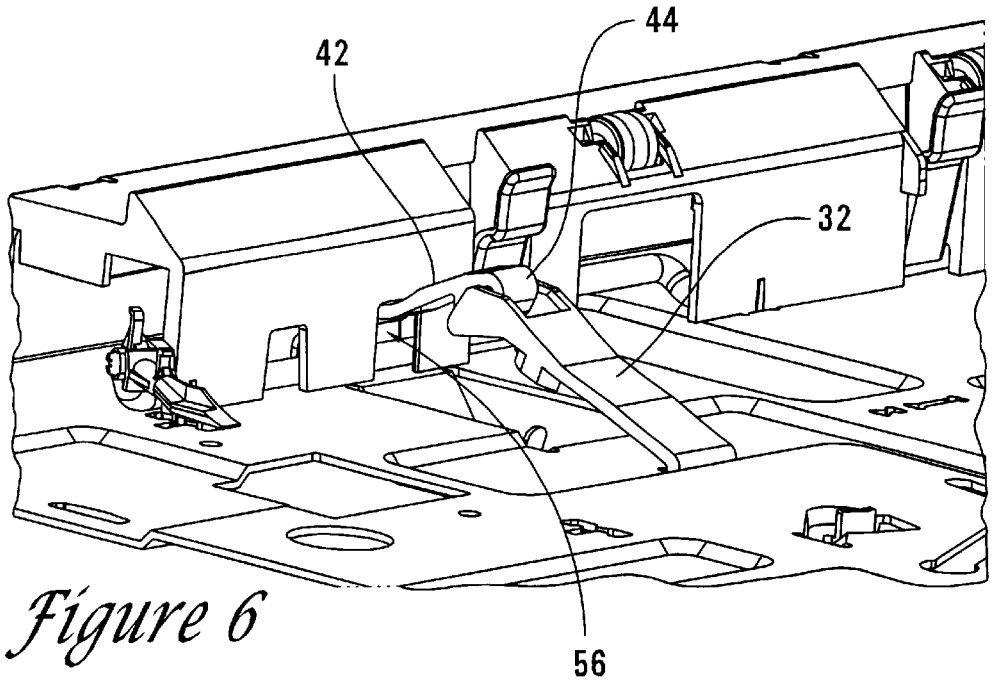
FIG. 6 is an isometric drawing of the biasing means shown assembled to the ink jet printer.

The second lever 42 includes two arms 54 laterally extending from the second end 50 of the second lever 42. FIG. 6 shows the biasing means 30 assembled on the printer 2. The arms 54 are disposed behind an aperture 56 in a retaining wall 58. The coil spring 36 is slightly compressed to urge the second end 50 of the second lever 42 against a portion of the retaining wall 18 that defines the top of the aperture 56. As a result, upward movement of the biasing means 30 is limited and the biasing means 30 is therefore firmly held in place to prevent it from being dislodged during transportation of the printer 2.

Figure 1A:
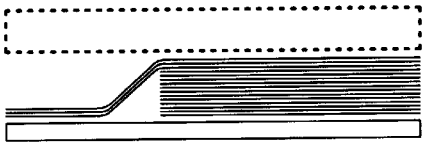
Fig. 1A (Prior Art)
FIGS. 1A and 1B are representative drawings showing a prior art sheet media handling system that includes a single pressure plate that is unable to provide adequate support of a larger width sheet media that is only partially supported by a smaller width sheet media thereunder.
Figure 1B:
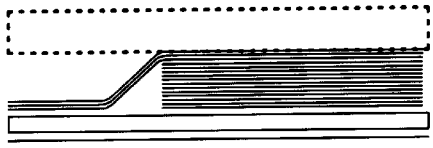
Fig. 1B (Prior Art)
Figure 7A:
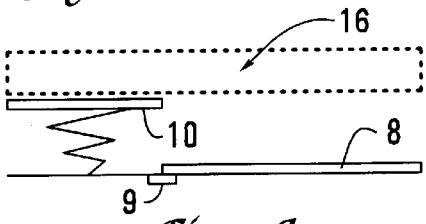
FIGS. 7A and 7B are representative drawings of the first support and the second support of FIG. 2 outside of and during a pick cycle of the ink jet printer respectively.

The operation of the sheet media handling system is next described with the aid of FIGS. 7A–11A and 7B–11B that show a representative first support 8 and a biased second support 10 supporting different sheet media. FIG. 7A shows the second support 10 biased to the datum position when no medium is placed on the pull-out tray 4 that is attached to the printer 2. In the datum position, it is preferable that the second support 10 does not come into immediate contact with the pick mechanism 14 as any contact may cause unnecessary wear and produce unwanted noise during operation of the printer 2.

Figure 7B:
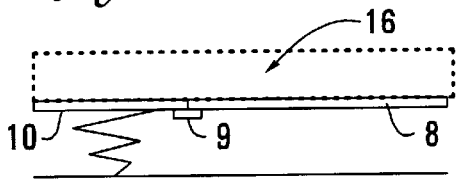

During the pick cycle of the printer, as the first support 8 is moved towards the infeed zone 16, the engagement portion engages an under surface of the second support 10 to thereby move the second support 10 together with the first support 8 to the infeed zone 16 as shown in FIG. 7B. When engaged in this manner, the upper surface of the second support 10 is substantially flush with the upper surface of the first support 8. Such a flush arrangement allows a sheet medium to be presented substantially flat to the pick mechanism 14 to prevent skew of the sheet medium. Between the datum position and the infeed zone 16, the second support 10 moves in accordance with the movement of the first support 10.

Figure 8A:
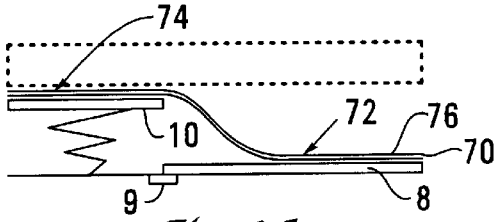
Figure 8A:
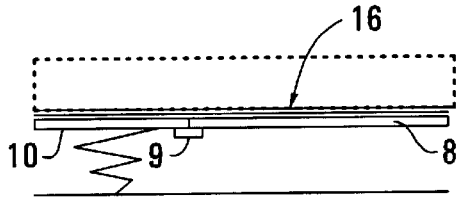

FIG. 8A shows a small stack 70 of large width sheet media placed either in the pull-out tray 4 or the bypass tray 6. The first support 8 supports a first portion of the stack 70 while the second support 10 supports a second portion 74 of the stack 70. The second support 10 collapses under the weight of the second portion 74 to maintain a topmost sheet 76 of the stack 70 clear of the infeed zone 16 when outside of the pick cycle. FIG. 8B shows the second support 10 raised together with the first support 8 to present the topmost sheet 76 to the infeed zone 16 during the pick cycle.

Figure 9A:
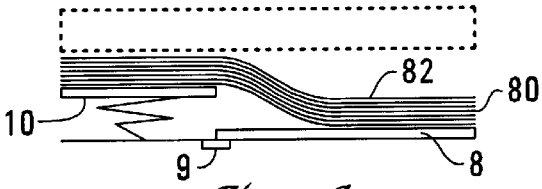
FIGS. 9A and 9B are drawings similar to FIGS. 7A and 7B, showing the first support and the second support supporting a relatively larger stack of large width sheet media than that shown in FIGS. 8A and 8B.
Figure 9B:
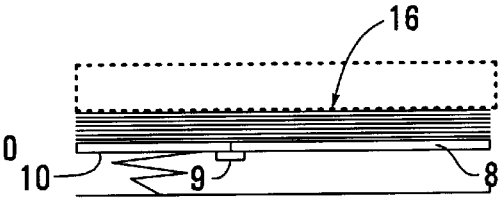

FIG. 9A shows a larger stack 80 of large width sheet media supported by the first 8 and the second support 10. Under the larger stack 80, the second support 10 collapses even more than that shown in FIG. 8A to maintain a topmost sheet 82 clear of the infeed zone 16 when the printer is not in a pick cycle. FIG. 9B is similar to FIG. 8B, showing the second support 10 being raised by the first support 8 to jointly present the topmost sheet 82 of to the infeed zone 16.

Figure 10A:
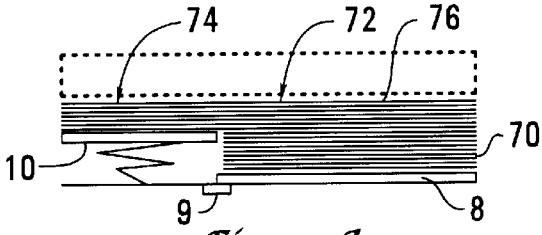
FIGS. 10A and 10B are drawings similar to FIGS. 7A and 7B, showing a large stack of small width sheet media supported by the first support and a small stack of large width sheet media that is partially supported by the stack of small width sheet media and partially supported by the second support.

FIG. 10A shows the first support 8 supporting a stack 90 of smaller width sheet media that supports a first portion 72 of a small stack 70 of larger width sheet media placed thereon. The second support 10 supports a second portion 74 of the stack 70. The stack 70 is therefore supported partially by the second support 10 and partially supported by the stack 90 of smaller width sheet media. The second support 10 collapses under the weight of the second portion 74 to define an offset between the first and the second portions 72, 74 of the larger width sheet media. During the pick cycle, as the first support 8 is raised to present the topmost sheet 76 to the infeed zone 16, the second support 10 though not engaged by the first support 8 rises with the first support 8. This rising of the second support 10 moves the second portion 74 of the topmost sheet 76 (the second portion 74 topmost of the stack 70) to within a predetermined tolerance X from the infeed zone 16 as shown in FIG. 10B.

Figure 10B:
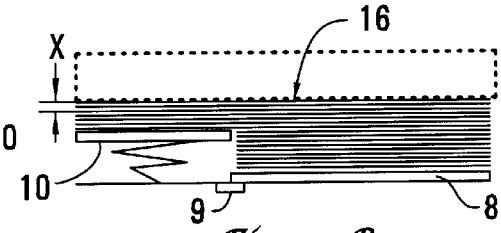
Figure 11A:
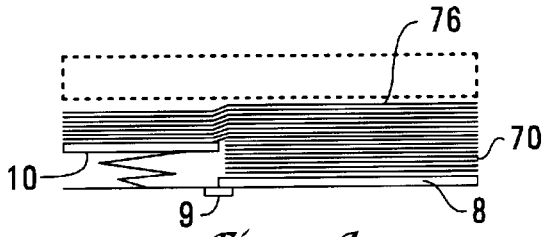
FIGS. 11A and 11B are drawings similar to FIGS. 10A and 10B, showing the support of a larger stack of large width sheet media than that shown in FIGS. 10A and 10B.
Figure 11B:
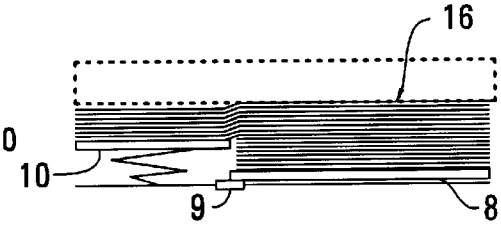

FIGS. 11A and 11B, which are similar to FIGS. 10A and 10B, show a larger stack 80 of the larger width sheet media placed on the stack 90 of smaller width sheet media. Due to the higher load on the second support 10, the second support 10 collapses more than that shown in FIGS. 10A and 10B to produce a larger offset between the first and second portions of the larger width sheet media. As long as the number of sheets of the larger width sheet media is kept to a predetermined number, the second portion of the topmost sheet 76 will be raised to within the predetermined tolerance X when the first support 8 is raised. The topmost sheet 76 will be received into the printer following substantially a straight media path.

Advantageously, the sheet handling system according to the embodiment of the present invention requires lesser space to implement than the prior art system disclosed in U.S. Pat. No. 6,152,440. The system is also user-friendlier in that a user needs not worry about manually activating the second support.

Figure 12A:
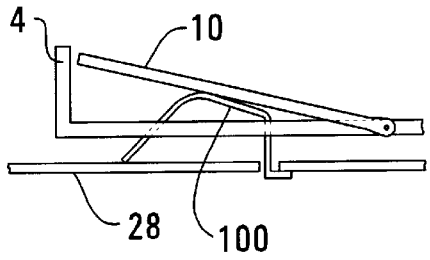
FIG. 12 is a side elevation drawing of an alternative biasing means.
Figure 12B:
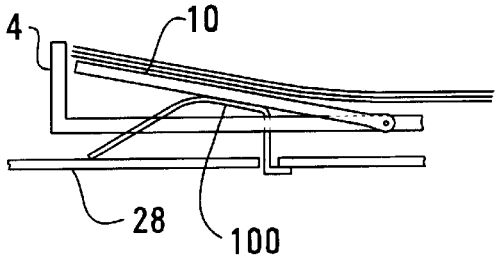

Although the present invention is described as implemented in a sheet media handling system having a separate bypass tray, the invention may also be implemented in a system having only a single main tray capable of accommodating sheet media of different widths. The main tray is also not limited to a pull-out tray as described. The main tray may be a receptacle in the printer with an opening for media to be inserted. In such a design, the first and second supports 8, 10 are pivotably attached to the base 28 of the printer 2 and the biasing means 30 may simply be a coil spring for directly biasing the second support. In the embodiment shown in FIG. 2, the biasing means 30 may be replaced with a leaf spring 100 as shown in FIGS. 12A and 12B. FIG. 12A shows the leaf spring 100 being biased only by the second support 10, and FIG. 12B shows the leaf spring 100 being further biased by a portion of sheet media on the second support 10. The leaf spring 100 is appropriately shaped and sized to bias the second support 10 according to the operational principles described above.

We claim:

1. A system for handling differing-width first and second sheet media in a printer comprising:

a first support for supporting first sheet media thereon;

a second support adjacent the first support for jointly supporting second sheet media wider than the first sheet media, the second support being for supporting a portion of the second sheet media not supported by the first support or by the first sheet media supported thereon; and a biasing means for biasing the second support, wherein the biasing means is collapsible under a portion of up to a predetermined number of sheets of the second sheet media such that the portion topmost in the second sheet media is only brought to within a predetermined tolerance of an infeed zone of the printer during a pick cycle when the first support is moved to present supported media thereon to the infeed zone.

2. A system according to claim 1, further including an engagement portion supported by the first support or the second support to allow the second support to be engaged and moved together with the first support during the pick cycle.

3. A system according to claim 1, further including a pull-out tray that supports the first and the second supports, the pull-out tray being slidable on a base of the printer for attachment to the printer.

4. A system according to claim 3, wherein the biasing means is supported on the base of the printer.

5. A system according to claim 4, wherein the biasing means includes a leaf spring.

6. A system according to claim 4, wherein the biasing means includes:

a first lever having a first end pivotably mounted to the base of the printer; and a coil spring for biasing the first lever to raise a second end of the first lever to define a first incline;

whereby when the pull-out tray is slidably attached to printer, the second support moves up the first incline to thereby be biased.

7. A system according to claim 6, wherein the biasing means further includes a second lever having a first end pivotably attached to the raised second end of the first lever and having a second end that extends in an opposite direction to the first lever to define a second incline.

8. A system according to claim 7, wherein the second lever includes at least one arm laterally extending from the second end and the sheet media handling system further including a retaining wall that engages the arm to hold the biasing means in place by compressing the coil spring.

9. A system according to claim 6, wherein the coil spring is a spiral.

10. A printer comprising:

a pick mechanism that defines an infeed zone; and a sheet media system for handling first and second sheet media of differing widths including:

a first support for supporting first sheet media thereon;

a second support adjacent the first support for jointly supporting second sheet media wider than the first sheet media, the second support being for supporting a portion of the second sheet media not supported by the first support or by the first sheet media supported thereon; and a biasing means for biasing the second support, wherein the biasing means is collapsible under a portion of up to a predetermined number of sheets of the second sheet media such that the portion topmost of the second sheet media is only brought to within a predetermined tolerance of the infeed zone during a pick cycle when the first support is moved to present supported media thereon to the infeed zone.

11. A printer according to claim 10, wherein the sheet media system further includes an engagement portion supported by the first support or the second support to allow the second support to be engaged and moved together with the first support during the pick cycle.

12. A printer according to claim 10, further including a pull-out tray that supports the first and the second supports, the pull-out tray being slidable on a base of the printer for attachment to the printer.

13. A printer according to claim 12, wherein the biasing means is supported on the base of the printer.

14. A printer according to claim 13, wherein the biasing means includes a leaf spring.

15. A printer according to claim 13, wherein the biasing means includes:

a first lever having a first end pivotably mounted to the base of the printer; and a coil spring for biasing the first lever to raise a second end of the first lever to define a first incline;

whereby when the pull-out tray is slidably attached to printer, the second support moves up the first incline to thereby be biased.

16. A printer according to claim 15, wherein the biasing means further includes a second lever having a first end pivotably attached to the raised second end of the first lever and having a second end that extends in an opposite direction to the first lever to define a second incline.

17. A printer according to claim 16, wherein the second lever includes at least one arm laterally extending from the second end and the sheet media handling system further including a retaining wall that engages the arm to hold the biasing means in place by compressing the coil spring.

18. A printer according to claim 15, wherein the coil spring is a spiral.

19. A sheet media handling system for a printer comprising:

a first support for supporting first sheet media thereon;

a second support adjacent the first support for jointly supporting second sheet media wider than the first sheet media, the second support being for supporting a portion of the second sheet media not supported by the first support or by the first sheet media supported thereon; and a biasing means for biasing the second support, the biasing means being collapsible under a portion of up to a predetermined number of sheets of the second sheet media such that the portion topmost in the second sheet media is only brought to within a predetermined tolerance of an infeed zone of the printer during a pick cycle when the first support is moved to present supported media thereon to the infeed zone.

* * * * *